United States Patent [19]

Petraitis et al.

[11] Patent Number: 4,866,408

[45] Date of Patent: Sep. 12, 1989

[54] MULTIPHASE MOTOR PROTECTOR APPARATUS

[75] Inventors: Jeffery J. Petraitis; Walfred Cardin; Lawrence Cooper; Dave Rountree, all of Attleboro; Leo A. Plouffe, N. Dighton, all of Mass.

[73] Assignee: Texas Instruments Incorporated, Dallas, Tex.

[21] Appl. No.: 264,122

[22] Filed: Oct. 28, 1988

[51] Int. Cl.[4] ..... H01H 61/02; H01H 37/12; H01H 37/52

[52] U.S. Cl. ..... 337/104; 337/89; 337/94; 337/372; 337/368

[58] Field of Search ..... 337/82, 86, 89, 93, 337/94, 97, 102, 104, 107, 349, 365, 368, 372

[56] References Cited

U.S. PATENT DOCUMENTS 3,452,313 6/1969 Perry ..... 337/86
4,231,010 10/1980 Cardin ..... 337/82
4,287,499 9/1981 Pejouhy ..... 337/97
4,376,926 3/1983 Senor ..... 337/104
4,555,686 11/1985 Pejouhy et al. ..... 337/102

*Primary Examiner*—H. Broome
*Attorney, Agent, or Firm*—John A. Haug; James P. McAndrews; Melvin Sharp

[57] ABSTRACT

A three phase hermetic protector for electrical apparatus has a pair of terminals extending through a header with first and second elongated heaters mounted on the terminals and extending away from the header. A rigid support is attached to the header between the terminals and extends away from the header and mounts a third elongated heater extending back toward the header. A snap acting disc is cantilever mounted on the free end of the third heater and mounts thereon a pair of movable contacts adapted to move into and out of the engagement with stationary contacts mounted at the free ends of the first and second heaters. The rigid support mounts a calibration screw beneath the free end of each of the first and second heaters to independently adjust the vertical position of the stationary contacts.

15 Claims, 1 Drawing Sheet

MULTIPHASE MOTOR PROTECTOR APPARATUS

Figure 1:
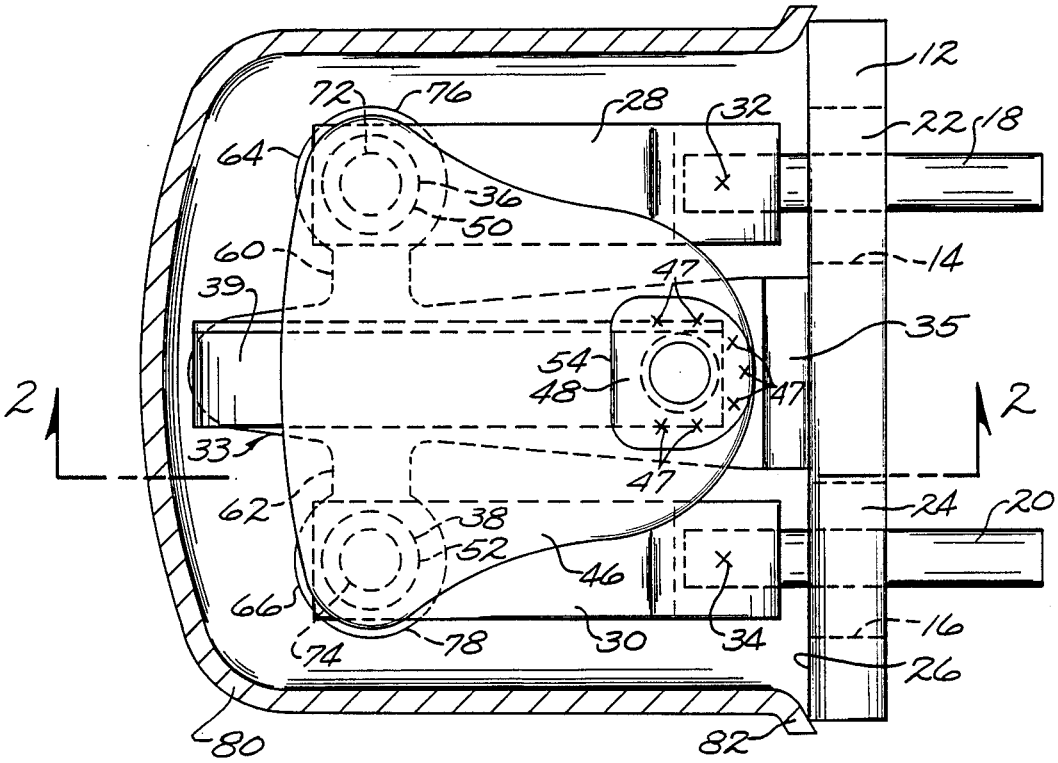

This invention relates generally to temperature responsive switches and more particularly to hermetic, three phase protectors for use in motor protection circuits or other similar electrical apparatus protection circuits. It is known to provide switches in which a temperature responsive snap acting disc is used in conjunction with heaters acting as thermal analogs of motor windings so that upon selected conditions the heat generated in the motor or in any or all of the heaters cause the snap acting disc to snap thereby opening movable contacts operatively connected to the disc thereby deenergizing the protected apparatus. For example, such switches are shown and described in U.S. Pat. Nos. 3,452,313, 4,231,010 and 4,555,686. These three phase switches employ a snap acting disc which is mounted at its center using a screw member to calibrate the switch by vertically adjusting the position of the disc support to adjust the contact gap and the force for contact pairs operatively connected to the disc. Although these switches have been very effective, there is a need to reduce the cost of such devices and to make them more conducive to automated manufacture. It is therefore an object of the invention to provide a three phase protector which is inexpensive to manufacture, one which can readily be calibrated using automated techniques and one which has a package configuration having a relatively smaller profile than prior art devices so that it can be easily mounted on windings of electrical apparatus to be protected.

Another object of the invention is the provision of a temperature responsive three phase protector which is responsive to each of the three phases of apparatus being protected. Yet another object is the provision of a protector whose calibration is relatively insensitive to deflections in the cap member enclosing the switch.

Briefly, in accordance with the invention, a generally oval metallic header plate mounts a pair of terminal pins each of which in turn mounts an end of an elongated strip heater. The heaters extend away from the header and mount at their distal free ends a stationary contact. A rigid support member, attached to the header intermediate the terminal pins, extends away from the header and mounts a third heater which in turn extends back toward the header. The third heater is structurally reinforced by a flange along its length to which the body portion of a welding slug is welded at the free end of the heater. A thermostatic snap acting disc is attached to the underside of the head of the welding slug to cantilever mount the disc. The disc is generally bell shaped having a head portion where the disc is mounted and having a mouth portion where two movable electrical contacts are mounted at opposite ends of the mouth which are adapted to move into and out of engagement with the stationary contacts. The movable contacts are preferably located slightly closer to the header than are the stationary contacts prior to device calibration. The head portion has a relatively straight bending edge contiguous to the disc which extends in a direction generally parallel to an imaginary line drawn through the centers of the movable contacts.

According to a feature of the invention the support member is provided with a pair of arms extending laterally from the support member to provide mounting pads disposed beneath the free distal ends of the first and second heaters. A self tapping calibration screw is received in an aperture in each mounting pad in alignment with the free distal end of a respective heater. An electrically insulating pad is interposed between each screw and its respective heater.

According to another feature of the invention the device is calibrated by taking a switch assembly, prior to the attachment of a cover with the disc in an upwardly convex surface configuration, heating the assembly to a selected calibration temperature allowing the disc to creep to a stabilized position with the contacts open, independently turning the screws, either sequentially or simultaneously, until one stationary contact engages its movable contact and continuing turning only the other screw until its stationary contact engages its movable contact. Then both screws are turned the same amount until the disc snaps to the opposite upwardly concave surface configuration with the movable contacts out of engagement with the stationary contacts.

The cover member which may be formed of a high strength low alloy steel to provide suitable pressure capability required for high pressure environments has an outwardly flared portion at its mouth which receives therein the outer edge of the header and its welded thereto to hermetically seal the protector thereby minimizing space occupied by the package.

Figure 2:
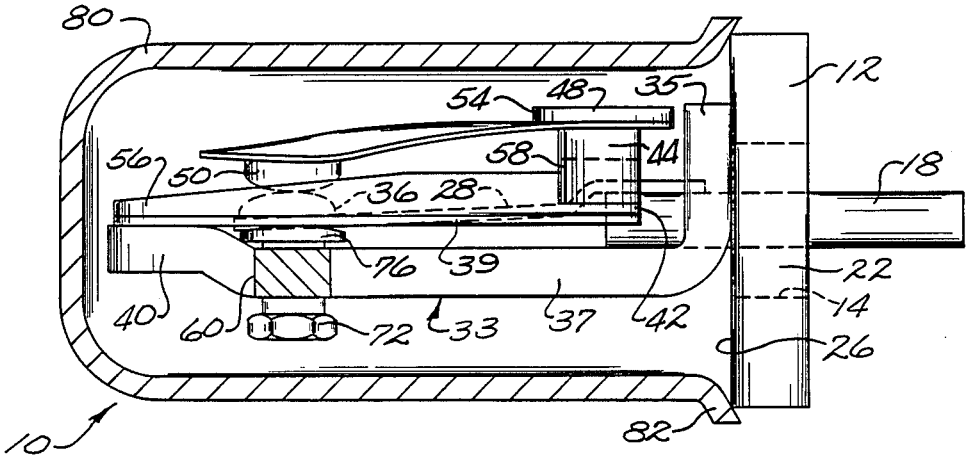

Other objects, advantages and details of the novel and improved protector of the invention appear in the following detailed description of the preferred embodiment of the invention, the detailed description referring to the drawings in which:

FIG. 1 is a top plan view of a protector made in accordance with the invention with the cover shown in cross section and FIG. 2 is a cross sectional view taken on lines 2—2 of FIG. 1.

Referring to the drawings, numeral 10 indicates the novel and improved protector of the invention. A header 12 of generally oval configuration of any suitable material which can be hermetically attached to an enclosing cover member to be described below, for example steel, has first and second apertures 14 and 16 mounting therein pins 18 and 20 electrically isolated from header 12 and hermetically sealed thereto in a known manner preferable by glass material 22, 24. Pins 18, 20 have a longitudinal axes generally parallel to one another and extending away from the header in a direction generally perpendicular to an inside face surface 26 of header 12 to form at their distal free ends mounts for elongated strip heater members 28, 30 welded thereto as indicated at 32, 34 respectively which in turn extend in a direction generally parallel to the longitudinal axes of the terminal members. Stationary contacts 36, 38 are attached to the free distal end of heater members 28, 30 by any suitable means, as by welding.

A rigid support member 33 of steel or other suitable material has a leg portion 35 attached to header 12 in a suitable manner, as by welding, and an elongated leg portion 37 disposed generally 90 degrees relative leg to portion 35 and extending away from face surface 26 in a direction generally parallel to the longitudinal axes of the terminal members. A strip heater 39 is attached to the free distal end 40 of support member 33 in any conventional manner, as by welding, and extends back toward header 12 culminating at a free end 42 spaced from leg portion 35. Free end 42 of heater 39 mounts thereon a welding slug 44 which in turn cantilever mounts one end of a snap acting bimetallic disc 46 by welding the disc as shown at 47 to head 48 adjacent the periphery of slug 44. That is, disc 46 is provided with an aperture through which slug 44 is received so that the disc can be welded to head 48.

Thermostatic disc 46 is provided with first and second movable electrical contacts 50, 52 attached to the underside of the disc in a conventional manner, as by welding at opposed sides of the distal free end of the disc. Contacts 50, 52 are adapted to move into and out of engagement with stationary contacts 36, 38 respectively upon snapping of disc 46. Head 48, disposed on the top surface of disc 46 is provided with a relatively straight bending edge 54 about which the disc bends when snapping to a contacts open configuration whereby distributing the bending stresses in the disc all along the length of the edge and keeping the stresses away from the welded portion of the disc. As will be noted in FIG. 1, welds 47 are disposed on the sides and free end portions of disc 46 but not adjacent bending edge 54 so that bending against any welds is avoided. Bending edge 54 extends in a direction generally parallel to an imaginary line drawn through the centers of movable contacts 50, 52 or, stated in another way, perpendicular to an imaginary line extending between the opposite fixed and free ends of the disc. Placing head 48 on the top surface of the disc so that bending edge 54 can be utilized minimizes calibration shifts in the disc which would otherwise occurr, particularly over time without having a calibration member engaging the central portion of the disc.

In order to enhance the matching of performance characteristic of the disc with that of the motor or other electrical apparatus being protected it is desirable to minimize the mass of the disc. For that reason the width of the disc is reduced along a line drawn from the center of the cantilever mounting to a point midway between the movable contacts with the width decreasing from the free end of the disc to the cantilever mount. Preferably, disc 46 is shaped generally as a bell with the cantilever mount located at the head of the bell and the movable contacts located at opposite sides of the mouth of the bell.

In order to provide a stable mount for disc 46, heater 39 is preferably provided with a reinforcing flange 56. Flange 56 is shown mounting welding slug 44 as by welding thereto and for that purpose extends to a greater height, as shown at 58, than the remainder of the flange, however, if desired, slug 44 can be welded directly to the flat portion of heater 39.

Support member 33 is provided with laterally extending arms 60, 62 which are provided with calibration screw mounting pads 64, 66 respectively disposed beneath the distal end of strip heaters 28, 30. Calibration screws 72, 74 are received in respective apertures formed in mounting pads 64, 66 and are used to transmit a bending force to the distal free end of the heaters to thereby adjust the vertical position of the respective stationary contacts. Support member 33 is electrically isolated from heaters 28 and 30 by insulative pads 76 and 78 disposed intermediate the screws and their respective heaters. The insulative pads are mounted in any convenient manner as by forming a detent portion to receive the end of the calibration screw to lock them laterally in position.

Movable contacts 50, 52 are located slightly closer to header 12 than are stationary contacts 36, 38 and come into closer vertical alignment during calibration. The protector is calibrated by taking a switch assembly before attachment of the enclosing cap with the disc at an at rest upwardly convex surface configuration, heating the assembly to a selected calibration temperature allowing the disc to creep to a stabilized position with the contacts open, separately (either simultaneously or sequentially) screwing in the calibrating screws until one stationary contact engages its respective movable contact and continuing turning only the other screw until its stationary contact engages its movable contact. The screws are then turned together the same amount until the disc snaps to the opposite upwardly concave surface configuration with the movable contacts out of engagement with the stationary contacts. Calibrating in this manner ensures that when the disc snaps to the upwardly convex configuration upon being heated to a selected temperature both movable contacts will simultaneously move out of engagement with their respective stationary contacts as required for proper operation.

A suitable cap member 80 formed for example of a high strength alloy encloses the volume around the switch structure providing suitable strength enabling the device to be placed in high pressure environments. Header 12 is welded internally to flange 82 of cap member 80 to minimize the profile of the protector.

It will be seen that a switch made in accordance with the invention offers a number of advantages. The parallel orientation of the terminal pins and the thermostatic disc permits placement of the protector on the windings in such a manner as to reduce its profile on the motor, that is the device does not stick out from the motor as much as conventional protectors. This profile is further minimized by welding the header on the internal surface of the flared cap flange. The use of a bending edge on top of the disc mounting one or more movable contacts results in improved performance of a cantilever mounted disc. The particular mounting of the disc without having a member contacting the center of the disc as in conventional three phase protectors allows wider parameters for discs which can be used for given motor ratings due to the ability to calibrate with the dual screws thereby facilitating manufacture of the protector as well as reducing the number of parts used in conventional protectors. Use of the dual screw calibration allows for compensation of uneven contact gaps produced during device assembly thereby making manufacture less expensive due to having wider acceptable tolerances. The use of the self-tapping screws avoids the need for a locking mechanism again reducing the number of parts required for the device. Mounting the disc assembly and the calibration means on the same support member renders the device less sensitive to shock and mounting the disc and heater assembly on the header completely independently of the cap renders the calibration of the protector insensitive and unaffected by deflections which might occur in the can. The three headers employed are of generally the same length with a heater connected in each of the three phases thereby providing equal trip time performance for each phase for protection in single phasing conditions.

It should be understood that the preferred embodiment of the protector of this invention has been described by way of illustrating the invention but that the invention includes all modifications and equivalents of the disclosed embodiment which fall within the scope of the appended claims.

What is claimed:

1. A three phase hermetic protector comprising a metallic header formed with first and second apertures therethrough, a terminal member having a longitudinal axis extending through each aperture and mounted therein in electrical isolation with the header by electrically insulative material, the longitudinal axis of the terminal members being generally parallel to one another, the terminal members having an inner free distal end, a switch assembly comprising two elongated heaters having two opposite ends, one end of a respective heater fixedly mounted on each free distal end and extending in a direction generally parallel to the longitudinal axis of the terminal member, a stationary electrical contact mounted on the other opposite end of each heater, a rigid support member mounted on the header and extending in a direction generally parallel to the longitudinal axes and disposed intermediate the terminals, a snap acting thermostatic disc having two opposite ends, one end of the disc cantilever mounted by the support member, a pair of movable electrical contacts mounted on the other end of the disc, each movable contact aligned with a respective stationary contact and means to adjust independently the vertical position of each stationary contact and metallic cap means surrounding the switch assembly and hermetically connected to the header.

2. A three phase hermetic protector according to claim 1 in which the support member has a free distal end and further comprising a third elongated heater member having first and second opposite ends, one end being attached to the free distal end of the support with the third heater member extending in a direction back toward the header and the disc is mounted on the second end of the third heater member.

3. A three phase hermetic protector according to claim 2 in which the third heater member has an upstanding flange to provide structural reinforcement and a welding slug is welded to the flange, the slug having a generally cylindrical body portion and having a head portion extending beyond the body portion, the disc being attached to the underside of the head portion, the head portion having a bending edge which extends in a direction generally parallel to an imaginary line passing through the movable contacts.

4. A three phase hermetic protector according to claim 3 further including lateral arms extending in opposite directions from the support member, an arm being disposed beneath the distal free end of the respective first and second heaters, an aperture provided in each arm in alignment with the distal free end of its respective heater, a calibration screw member received in each aperture and adapted to bend the distal end of its respective heater in an upward direction to thereby adjust the vertical position of the respective stationary contact and electrical insulation means interposed between the screw members and their respective heaters.

5. A three phase hermetic protector according to claim 4 in which the calibration screws are self tapping.

6. A three phase hermetic protector according to claim 4 in which the electrical insulation means comprises a pad of electrically insulative material.

7. A protector device comprising a header having a plate with at least one aperture extending therethrough, a terminal extending through the aperture and mounted electrically isolated from the plate by electrically insulative glass material, a switch assembly comprising a thermostatic snap acting disc having two opposite ends, a movable contact mounted on the bottom of one opposite end of the disc, a support, the disc cantilever mounted at its other opposite end on one of the terminals and the support, the cantilever mount including a welding slug having a head portion disposed on top of the disc, the head portion having a generally straight bending surface contiguous to the top surface of the disc and extending in a direction generally perpendicular to an imaginary line extending between the opposite ends of the disc, the bending surface being spaced from portions of the disc welded to the welding slug, a stationary contact mounted on the other of the terminal and the support and cap means emclosing the switch assembly and connected to the header.

8. A method for calibrating an hermetic motor protector including the steps of taking an assembly having a cantilever mounted snap acting disc with first and second spaced movable contacts mounted adjacent an end of the disc, the protector having first and second stationary contacts each mounted on a bendable member in alignment with the movable contacts and having a support member mounting first and second calibration screws disposed beneath a respective bendable member mounting the stationary contacts, taking the assembly with the disc in an at rest upwardly convex surface configuration, turning each calibration screw independently until one stationary contact engages its respective movable contact, continue turning the other calibration screw until the other stationary contact engages its respective movable contact, then turning both calibration screws together the same amount until the disc snaps to move the movable contacts out of engagement with the stationary contacts thereby compensating for any difference in contact gaps originally existing in the assembled protector.

9. A multiphase hermetic protector comprising header means, the header means having a generally oval metallic plate having an inside surface and provided with a pair of spaced apart apertures, a terminal extending through each aperture and mounted electrically isolated from the plate by electrically insulative glass material, the terminals each being in the form of a cylindrical pin having a longitudinal axis, the two axes being generally parallel to one another, a switch assembly comprising first and second elongated strip heaters having first and second ends, the first end of a heater welded to each terminal, a stationary electrical contact mounted on each second end of the two heaters, a rigid support member mounted on the inside surface of the header intermediate the apertures and extending in a direction generally parallel to the axes of the terminals, a third strip heater having a first end mounted on the support, the heater extending back toward the header and culminating at a free distal end, a thermostatic snap-acting disc cantilever mounted on the free distal end of the third heater, the disc mounting first and second movable contacts aligned with the respective first and second stationary contacts and movable into and not of engagement therewith, the support member having arms projecting laterally therefrom and mounting calibration screws aligned with and disposed beneath the second end of the respective first and second heaters, the calibration screws adapted to bend the heaters to independently adjust the vertical position of the stationary contacts, electrical insulative means interposed between the calibration, screws and their respective heaters and cap means enclosing the switch assembly and hermetically sealed to the header.

10. A multiphase hermetic protector according to claim 9 in which the snap acting disc is generally bell shaped having a head portion and a mouth portion with the head of the disc mounted on the third heater and the movable contacts mounted at opposite extremities of the mouth portion.

11. A multiphase hermetic protector according to claim 9 in which the cap is a cup shaped member having an outwardly flared open end portion and the header is received within the flared portion and is welded thereto to minimize the profile of the protector.

12. A multiphase hermetic protector according to claim 9 including welding slug means for mounting the disc to the third heater, the welding slug including a head portion disposed on top of the disc, the head portion having a generally straight bending surface contiguous to the top surface of the disc and extending in a direction generally parallel to an imaginary line extending through the movable contacts.

13. A multiphase hermetic protector according to claim 9 in which the first, second and third heaters are essentially the same length with each heater adapted to be connected to a separate phase winding of the apparatus to be protected to provide protection from single phasing conditions.

14. A method according to claim 8 in which the calibration screws are turned sequentially in initially engaging their respective movable contacts.

15. A method according to claim 8 in which the calibration screws are turned simultaneously in initially engaging their respective movable contacts.

* * * * *